United States Patent [19]

Peterson et al.

[11] Patent Number: 4,988,554

[45] Date of Patent: Jan. 29, 1991

[54] ABRASIVE ARTICLE COATED WITH A LITHIUM SALT OF A FATTY ACID

[75] Inventors: Scott W. Peterson, Eagan; Marvin J. Schroeder, Woodbury, both of Minn.

[73] Assignee: Minnesota Mining and Manufacturing Company, St. Paul, Minn.

[21] Appl. No.: 370,812

[22] Filed: Jun. 23, 1989

[51] Int. Cl.[5] ..... B32B 5/16; C09J 7/02; C09K 3/14

[52] U.S. Cl. ..... 428/142; 428/143; 428/144; 428/148; 428/149; 428/150; 428/352; 428/354; 428/343; 428/454; 428/511; 428/906; 51/304; 51/295; 51/298

[58] Field of Search ..... 51/304, 295, 298; 428/142, 143, 144, 148, 149, 150, 352, 354, 343, 454, 511, 906

[56] References Cited

U.S. PATENT DOCUMENTS

| | | | |
|---|---|---|---|
| 2,768,886 | 10/1956 | Twombly | 51/295 |
| 2,893,854 | 7/1959 | Rinker et al. | 51/298 |
| 3,619,150 | 11/1971 | Rinker et al. | 51/295 |
| 3,849,949 | 11/1974 | Steinhauser et al. | 51/406 |
| 4,011,063 | 3/1977 | Johnston | 51/298 |
| 4,355,489 | 10/1982 | Heyer et al. | 51/297 |
| 4,360,557 | 11/1982 | Miller | 428/144 |
| 4,486,200 | 12/1984 | Heyer et al. | 51/295 |
| 4,609,380 | 9/1986 | Barnett et al. | 51/298 |
| 4,667,447 | 5/1987 | Barton | 428/144 |
| 4,784,671 | 11/1988 | Elbel | 51/293 |

FOREIGN PATENT DOCUMENTS 56-69074 6/1981 Japan .

*Primary Examiner*—Patrick J. Ryan
*Assistant Examiner*—William P. Watkins, III
*Attorney, Agent, or Firm*—Donald M. Sell; Walter N. Kirn; David L. Weinstein

[57] ABSTRACT

A coated abrasive article comprising a backing bearing on one major surface thereof a layer of abrasive grains overcoated with a loading resistant coating and on the other major surface thereof a layer of pressure-sensitive adhesive. The loading resistant coating comprises a lithium salt of a fatty acid. It may also contain additives selected from the group consisting of surfactants, wetting agents, binders, anti-foaming agents, fillers, plasticizers, and mixtures thereof. The use of a lithium salt of a fatty acid significantly reduces the amount of transfer between the loading resistant coating of a first coated abrasive article and the pressure-sensitive adhesive layer of a second coated abrasive article disposed within a package.

15 Claims, 1 Drawing Sheet

ABRASIVE ARTICLE COATED WITH A LITHIUM SALT OF A FATTY ACID

FIELD OF THE INVENTION

This invention relates to coated abrasive articles, and more particularly, to coated abrasive articles that can be adhered to abrading equipment by means of a pressure-sensitive adhesive.

BACKGROUND OF THE INVENTION

Coated abrasive articles are used to abrade a wide variety of substrates or workpieces, such as, for example, wood, wood-like materials, plastics, fiberglass, soft metal alloys, enameled surfaces, and painted surfaces. One problem common to all of these different substrates or workpieces is "loading" or clogging, i.e., particles from the workpiece undergoing abrasion become lodged between the abrasive grains, thereby reducing the cutting ability of the coated abrasive, even though the abrasive grains are not worn. Consequently, loading substantially reduces the useful life of a coated abrasive article. In an attempt to overcome this problem, U.S. Pat. Nos. 2,768,886; 2,893,854; and 3,619,150 disclose the use of a coating comprising a metal stearate, metal palmitate, or metal laurate applied over the layer of abrasive grain. These patents disclose that the metal can be selected from the group consisting of magnesium, calcium, strontium, barium, chromium, zinc, cadmium, aluminum, and lead.

Coated abrasive articles are typically converted into a wide variety of different forms such as discs, cones, and sheets. If the converted form is a disc, it is often preferable to have a layer of pressure-sensitive adhesive coated on the major surface of the coated abrasive disc not bearing the abrasive grains. The coated abrasive disc can then be secured to a support pad and when the abrasive disc is consumed, it can be removed and replaced with a new abrasive disc. Such coated abrasive discs are typically packaged in roll form, with the result that the pressure-sensitive adhesive from one disc comes in contact with the grain-bearing surface of another disc. If the disc contains a metal stearate coating, e.g., zinc stearate, there is a tendency for the metal stearate to transfer from the grain-bearing surface of one disc to the pressure-sensitive adhesive surface of the other disc. If the metal stearate does transfer, it significantly reduces the adhesion characteristics of the pressure-sensitive adhesive. This can detract from operating performance. For example, if the adhesive strength of the pressure-sensitive adhesive is insufficient, the coated abrasive disc may not adhere properly to the support pad, and during use, the coated abrasive disc could fly off the pad, thereby forcing the operator to cease abrading operations.

One solution to the stearate transfer problem is to have a release liner containing a low surface energy material placed over the layer of pressure-sensitive adhesive. However, the use of a release liner poses additional problems for operators. A typical low surface energy coating of a release liner consists of silicone-based materials. When coated abrasive discs are utilized in paint related areas, the liner can come into contact with a painted surface, and the silicone can transfer to the painted surface and contaminate it. Also, operators must dispose of the liners and silicone-containing materials, which results in increased cost. For these reasons, it is preferable that coated abrasive discs that utilize a layer of pressure-sensitive adhesive not have a liner associated with them.

It is thus desired to have coated abrasive discs that have both a loading resistant coating and a layer of pressure-sensitive adhesive without a liner, but in which the material of the loading resistant coating of one disc does not significantly transfer to the layer of pressure-sensitive adhesive of another disc.

U.S. Pat. No. 4,486,200 discloses lithium stearate as a lubricant for non-woven abrasive products and U.S. Pat. No. 4,784,671 discloses lithium stearate as a lubricant for grinding wheels. Japanese patent application Kokai No. 56-69074 pertains to a coated abrasive containing a fatty acid metallic soap that has been treated with a surfactant. The metal can be selected from the group consisting of calcium, zinc, lithium, and barium; and the fatty acid can be selected from the group consisting of stearic, palmitic, oleic, and lauric acids. None of the foregoing references teach the use of a coated abrasive containing both a lithium salt of a fatty acid as a loading resistant coating and a layer of pressure-sensitive adhesive.

SUMMARY OF THE INVENTION

This invention provides a coated abrasive article having a backing having two major surfaces, on one of which surfaces is disposed a layer of abrasive grains overcoated with a loading resistant coating and on the other of which surfaces is disposed a layer of pressure-sensitive adhesive. The abrasive grains are bonded to the backing by means of one or more binders. The loading resistant coating comprises a lithium salt of a fatty acid, e.g., lithium stearate. It may also include additives selected from the group consisting of binders, fillers, plasticizers, anti-static agents, dyes, pigments, and mixtures and combinations thereof.

Typical examples of lithium salts of fatty acids include lithium stearate, lithium palmitate, lithium myristate, lithium laurate, lithium decanoate, lithium octanoate, lithium undecylenate, lithium oleate, and mixtures thereof. The preferred lithium salt of a fatty acid is lithium stearate.

Typically, a package of coated abrasive products contains at least two coated abrasive articles disposed such that the loading resistant coating of one article will be in direct contact with the layer of pressure-sensitive adhesive of another article. The use of a lithium salt of a fatty acid significantly reduces the amount of transfer between the loading resistant coating of a first disc and the layer of pressure-sensitive adhesive of a second disc in contact with the first disc. This results in a coated abrasive disc that is safer to use, since the pressure-sensitive adhesive layer will not be contaminated with loading resistant coating material. In addition, higher coating weights of the lithium salt of a fatty acid can be utilized, which results in increased anti-loading performance, while eliminating the concern of increased transfer of loading resistant coating material from one disc to the pressure-sensitive adhesive layer of another disc.

This invention further provides a package of coated abrasive products having at least two coated abrasive articles wherein the loading resistant coating of a first coated abrasive article is in direct contact with the layer of pressure-sensitive adhesive of a second coated abrasive article. It is preferred that the abrasive products be packaged in such a way as to provide a concatenation of pressure-sensitive adhesive-coated abrasive discs convolutely wound to form a roll which can easily be unrolled. Each disc is connected with at least one other disc at a line of tangency.

This invention further provides a roll of coated abrasive material, wherein the roll comprises an elongated backing having two major surfaces, on one of which surfaces is disposed a layer of abrasive grains overcoated with a loading resistant coating and on the other of which surfaces is disposed a layer of pressure-sensitive adhesive. The abrasive grains are bonded to the backing by means of one or more binders.

DETAILED DESCRIPTION

Figure 1:
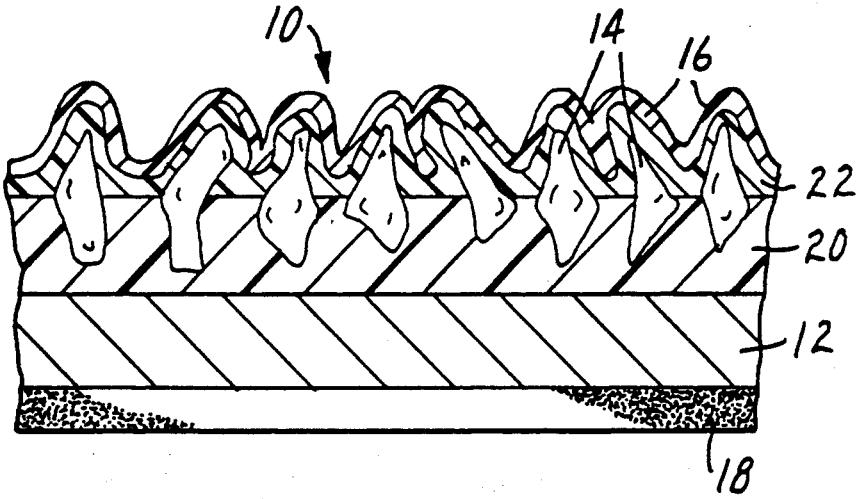
FIG. 1 is a view in cross-section of a coated abrasive article of this invention.

This invention involves a coated abrasive article 10 having a backing 12 having on one major surface thereof a layer of abrasive grains 14 overcoated with a loading resistant coating 16 comprising a lithium salt of a fatty acid and on the other major surface thereof a layer of pressure-sensitive adhesive 18. Referring to FIG. 1, backing 12 is preferably formed from paper, cloth, polymeric film, polymeric fiber, non-woven material, woven material, and combinations and treated versions thereof. Abrasive grains 14 are preferably made of a material selected from the group consisting of aluminum oxide, ceramic aluminum oxide, alumina zirconia, silicon carbide, flint, garnet, diamond, and mixtures thereof Typically, abrasive grains 14 are secured to backing 12 by a first adhesive layer or binder layer 20, commonly referred to as the "make coat". Another adhesive layer or binder layer 22 can be applied over the abrasive grains. Layer 22 is commonly referred to as the "size coat". Layer 22 provides additional reinforcement for abrasive grains 14. Common adhesives and binders for layers 20 and 22 include phenol-formaldehyde, melamine-formaldehyde, urea-formaldehyde, glue, epoxy resins, acrylate resins, latices, combinations, and mixtures thereof. Alternatively, the coated abrasive article need not have both a make coat and size coat, but, instead, the abrasive grains can be mixed with an adhesive or binder and then applied to the backing as a slurry. The abrasive grains are then secured by a single adhesive or binder layer. Loading resistant coating 16 is applied over the size coat or the single binder layer, whatever the case may be. A layer of pressure-sensitive adhesive 18 is applied to the major surface of backing 12 not bearing abrasive grains 14. The layer of pressure-sensitive adhesive 18 serves to secure coated abrasive article 10 to a support pad (not shown).

Loading resistant coating 16 prevents particles from the workpiece being abraded from becoming lodged between abrasive grains 14. This, in turn, increases the life of the coated abrasive.

Loading resistant coating 16 is typically applied to the coated abrasive article as a lithium salt of a fatty acid dispersed within a liquid medium. The liquid medium can be organic solvent or water. After the dispersion is applied, it is then dried, typically at a temperature between about 20° and 100° C. for between about 0.1 to 30 hours, to leave a coating of a lithium salt of a fatty acid over the size coat or single binder layer. The loading resistant coating may optionally contain a surfactant, a binder, a plasticizer, an anti-static agent, a wetting agent, an anti-foaming agent, a filler, a dye, a pigment, or combinations of these materials.

As used herein, the term "fatty acid" means a long chain fatty acid having from 6 to 24 carbon atoms (see Kirk-Othmer *Encyclopedia of Chemical Technology*, 3rd edition, Vol. 4, John Wiley and Sons, Inc. (1978), pp. 814–844, incorporated herein by reference). Fatty acids can be saturated or unsaturated. Lithium salts of saturated fatty acids can be represented by the formula:

$$CH_3(CH_2)_x-\overset{\overset{\displaystyle O}{\|}}{C}-O-Li$$

where x represents an integer ranging from 4 to 22, inclusive. If x represents 16, the lithium salt is lithium stearate; likewise if x represents 14, the lithium salt is lithium palmitate; if x represents 12, the lithium salt is lithium myristate; if x represents 10, the lithium salt is lithium laurate; if x represents 8, the lithium salt is lithium decanoate; and if x represents 6, the lithium salt is lithium octanoate. The fatty acid can also be unsaturated as in the case of lithium undecylenate, $$CH_2=CH(CH_2)_7\overset{\overset{\displaystyle O}{\|}}{C}-O-Li$$

and lithium oleate, $$CH_3(CH_2)_7CH=CH(CH_2)_7\overset{\overset{\displaystyle O}{\|}}{C}-O-Li.$$

Lithium stearate is the preferred lithium salt of fatty acid for this invention.

It is preferred to use lithium salts of fatty acids that have high softening points. During abrading applications, a considerable amount of heat can be generated, which may soften the loading resistant coating to the point that the performance of the coated abrasive is substantially reduced and may cause the loading resistant coating to smear on the workpiece being abraded. The softening point of the lithium salts suitable for this invention should exceed 120° C. Lithium stearate has a softening point of about 212° C.

Lithium stearate and other lithium salts of fatty acids can be produced by a fusion process or by a precipitation process. The simpler of these two processes, the fusion method, reacts a lithium oxide, hydroxide, or lithium salt of a weak acid directly with selected fatty acid at an elevated temperature. Generally, steel reactors are employed and are equipped for proper agitation and application of heat.

Precautions are taken to obtain a controllable and uniform reaction. As water is driven off, the reaction is completed to form a molten mass. This is then cooled, crushed, pulverized, classified for desired particle size and packaged. Salts prepared in this manner have the appearance of a fine but dense powder and are also substantially free of moisture and foreign salts.

In the second process, the precipitation method, a dilute soluble soap solution is first prepared by reacting caustic soda with selected fatty acid. A separately prepared salt solution of lithium is then added to the soluble soap solution to bring about precipitation of the lithium salt.

Operating variables affecting the precipitation process are the concentration of solutions, temperature, rates of addition of reactants and efficiency of agitation. Moreover, the end results are also influenced by the type of filtration equipment used, the efficiency of washing, and the temperature and methods of drying and grinding. Both processes for producing lithium salts of fatty acids are equally acceptable for the present invention.

Lithium salts of fatty acids can be blended with other metal salts of fatty acids. For example, lithium stearate can be blended with zinc stearate or calcium stearate. The addition of the lithium stearate significantly reduces the transfer associated with either zinc stearate or calcium stearate.

Lithium salts of fatty acids are generally insoluble in water and sparingly soluble in organic solvents such as ketones, esters, alcohols, and mixtures thereof. However, if an appropriate surfactant is employed, lithium salts of fatty acids may become dispersible in water. It is preferred to use water as the solvent instead of an organic solvent in order to minimize environmental concerns associated with solvent removal. In general, the weight percent of the surfactant typically ranges from about 0.01 to 10% of the total formulation. Representative examples of surfactants include polyoxyethylene alkylphenolether, sodium alkylsulfate, polyoxyethylene alkylester, polyoxyethylene alkylether, polyhydric alcoholesters, polyhydric esterethers, sulfonates, and sulfosuccinates. The surfactant can be added directly to the loading resistant formulation, or the lithium salt of the fatty acid can be pre-treated with the surfactant and then added to the formulation.

Binders can also be added to reinforce or strengthen the loading resistant coating. Representative examples of such binders include cellulosics, polyacrylates, polymethacrylates, vinyl resins, casein, soy proteins, sodium alginate, polyvinyl alcohol, urea-formaldehyde resin, melamine-formaldehyde resin, phenol-formaldehyde resin, polyvinylacetate, polyacrylester, polyethylene vinylacetate, polystyrene-butadiene rubber latex, and polyacrylonitrile-butadiene rubber latex. The preferred binders are cellulosics. In general, the binder can comprise up to 50% by weight of the formulation for the loading resistant coating.

Other additives, such as, for example, wetting agents, plasticizers, anti-foaming agents, anti-static agents, fillers, dyes, and pigments, can be incorporated in the formulation for the loading resistant coating. Representative examples of fillers include talc, silica, silicates, and carbonates.

It has also been discovered that the particle size of the lithium salt of a fatty acid has an effect on the performance of the coated abrasive. The particle size can range from about 2 to about 25 micrometers, preferably from about 5 to about 12 micrometers. In general, smaller particle size results in improved loading resistant properties and lower transfer to the layer of pressure-sensitive adhesive. However, excessively small particle size results in processing difficulties, and, consequently, should be avoided.

The weight of the loading resistant coating depends upon the grade of coated abrasive, i.e., the particle size of the abrasive grain. In general, the larger the size of the abrasive grain, the higher should be the weight of the loading resistant coating. If the weight of the loading resistant coating is too high for a given grade of coated abrasive, the loading resistant coating will tend to flake off of the abrasive surface in large pieces rather than in powdered granules. This flaking results in reducing the loading resistant characteristics of the coating, and, consequently, should be avoided.

Fine grade coated abrasives tend to transfer more loading resistant coating material to the pressure-sensitive adhesive than do coarse grade coated abrasives; accordingly, the invention is especially useful in these products.

The loading resistant coating formulation can be applied to the coated abrasive by any suitable means, such as, for example, roll coating, die coating, and spraying. Roll coating deposits a ridge-like pattern of the loading resistant coating over the abrasive grains. A ridge-like pattern provides better loading resistant properties than does a smooth pattern.

On the major surface of backing 12 opposite the major surface bearing abrasive grains 14 is disposed layer 18 pressure-sensitive adhesive. Layer 18 of pressure-sensitive adhesive must have sufficient adhesive strength to secure the coated abrasive to a support pad during use. For example, a typical coated abrasive disc/support pad composite may rotate as many as 14,000 revolutions per minute. If the layer of pressure-sensitive adhesive does not have sufficient adhesive strength for the abrading application, the coated abrasive disc can fly off of the support pad and injure an operator. Representative examples of pressure-sensitive adhesives suitable for this invention include latex crepe, rosin, acrylic polymers and copolymers, e.g., polybutylacrylate, polyacrylate ester, vinyl ethers, e.g., polyvinyl n-butyl ether, alkyd adhesives, rubber adhesives, e.g., natural rubber, synthetic rubber, chlorinated rubber, and mixtures thereof. The preferred pressure-sensitive adhesive is an isooctylacrylate:acrylic acid copolymer.

After the coated abrasive of this invention is made, it can be converted into a variety of products, such as sheets and discs. The coated abrasive articles of this invention can be packaged in a manner such that the loading resistant coating of a first article can be in direct contact with the layer of pressure-sensitive adhesive layer of a second article (see, for example, U.S. Pat. No. 3,849,949). During packaging, the amount of transfer between the loading resistant coating of a first article to the layer of pressure-sensitive adhesive of a second article is substantially reduced.

Figure 2:
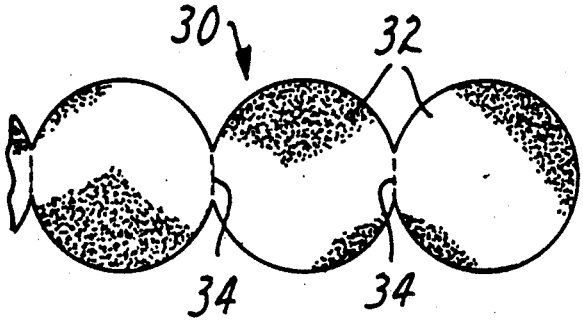
FIG. 2 is a plan view of a portion of a concatenate of abrasive discs capable of forming a roll in accordance with this invention.

FIG. 2 shows a concatenation 30 of coated abrasive discs capable of being convolutely wound to form a roll which can be easily unrolled. This concatenation is more fully described in assignees, U.S. Pat. No. 3,849,949, incorporated herein by reference. Each disc 32 is joined to at least one other disc 32 along a line 34 substantially tangent to the discs. Line 34 is of a length less than one-half the radius of the discs and is preferably perforated for easy separation of the discs. In this concatenation 30 of coated abrasive discs, the loading resistant coating of one disc will be in direct, releasable contact with the layer of pressure-sensitive adhesive of another disc when the concatenation is convolutely wound. There is no release liner associated with this type of coated abrasive disc assembly and the discs can be easily separated from one another.

Figure 3:
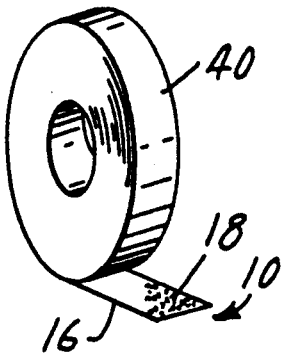
FIG. 3 is a perspective view of a roll of coated abrasive material of this invention of the type shown in FIG. 1.

FIG. 3 shows a roll 40 of coated abrasive material of this invention. Roll 40 comprises an elongated sheet of coated abrasive material of the type shown in FIG. 1. The materials of construction suitable for roll 40 are the same as those that can be used for coated abrasive article 10. In FIG. 3, it can be seen that when the coated abrasive material is wound up into a roll, loading resistant coating 16 will be in direct, releasable contact with layer of pressure-sensitive adhesive 18. When the user desires to remove a piece of coated abrasive material from roll 40, he merely unwinds a portion of roll 40 and cuts or tears this portion from the roll.

The following non-limiting examples will further illustrate the invention. All percentages are percentages by weight, unless otherwise indicated.

The coated abrasive base product utilized in all of the following examples consisted of an A weight paper backing, a hide glue make coat, a urea-formaldehyde size coat and grade P400 fused aluminum oxide abrasive grain.

CONTROL EXAMPLE A

A loading resistant formulation consisting of 72.52% water, 2.4% cellulosic binder, 0.62% sulfosuccinate wetting agent, 0.5% hydrocarbon anti-foaming agent, 5% ethylene glycol monoethyl ether and 19% zinc stearate was prepared. The zinc stearate was purchased from Witco Corporation and had an average particle size of 12 micrometers. This loading resistant formulation was roll coated over the abrasive-bearing surface of the coated abrasive base product. The formulation was then dried at room temperature for 24 hours. The resulting product was then converted into a 12.7 centimeter diameter disc and tested according to the Stearate Transfer Test and the Offhand Sanding Test described below. The test results are set forth in Table 1 and Table 2.

CONTROL EXAMPLE B

The coated abrasive for Control Example B was made and tested in the same manner as that of Control Example A, except that the average particle size of the zinc stearate was 10 micrometers. The zinc stearate was purchased from Witco Corporation and had the trade designation zinc stearate Type 42. The test results are set forth in Table 1 and Table 2.

CONTROL EXAMPLE C

The coated abrasive for Control Example C was made and tested in the same manner as that of Control Example A, except that the zinc stearate was replaced with an equal amount of calcium stearate. The calcium stearate was purchased from Witco Corporation and had the trade designation calcium stearate R. It had an average particle size of 12 micrometers. The test results are set forth in Table 1.

EXAMPLE 1

The coated abrasive for Example 1 was made and tested in the same manner as that of Control Example A except that the zinc stearate was replaced with an equal amount of lithium stearate. The lithium stearate was purchased from Witco Corporation and had the trade designation FS Type lithium stearate. It had an average particle size of 12 micrometers. The test results are set forth in Table 1 and Table 2.

EXAMPLE 2

The coated abrasive for Example 2 was made and tested in the same manner as that of Control Example B, except that one-half of the zinc stearate was replaced with an equal amount of lithium stearate. Accordingly, the loading resistant formulation contained a 50/50 blend of zinc stearate and lithium stearate. The lithium stearate was purchased from Witco Corporation and had the trade designation FS Type lithium stearate. It had an average particle size of 12 micrometers. The test results are set forth in Table 1 and Table 2.

STEARATE TRANSFER TEST

A 12.7 centimeter diameter coated abrasive disc (hereinafter "experimental disc") was stacked in a 15.2 centimeter square steel platen press (Model No. PC2512, Neucon Inc.) with a second coated abrasive disc (hereinafter "conventional disc"). The major surface of the conventional disc not bearing abrasive grains was coated with a pressure-sensitive adhesive consisting of isooctylacrylate:acrylic acid copolymer. The weight of the layer of pressure-sensitive adhesive was 2.2 milligrams/square centimeter. The discs were placed such that the layer of pressure-sensitive adhesive of the conventional disc was in direct contact with the loading resistant coating of the experimental disc. The press was operated at room temperature and generated a pressure of 5.9 kilograms/square centimeter. The press cycle time was 60 seconds. The conventional coated abrasive disc was weighed before and after pressing to determine the amount of material transferred from the loading resistant coating of the experimental disc to the layer of pressure-sensitive adhesive of the conventional disc. For the purpose of the Stearate Transfer Test, the experimental discs were those of Examples 1 and 2 and Control Examples A, B, and C. The results are set forth in Table 1.

TABLE 1

| Example | Weight of loading resistant coating ($mg/cm^2$) | Amount of loading resistant coating transferred (mg) |
|---|---|---|
| Control B | 0.94 | 27.5 |
| Control C | 1.08 | 25.5 |
| 1 | 1.24 | 15.3 |
| Control B | 0.98 | 37.5 |
| Control C | 0.89 | 36.5 |
| 1 | 0.92 | 20.3 |
| Control A | 1.13 | 85.7 |
| 1 | 1.15 | 13.3 |
| 2 | 1.15 | 18.7 |

It can be seen from the data in Table 1 that significantly less lithium stearate transfers to the layer of pressure-sensitive adhesive from the loading resistant coating than does zinc stearate or calcium stearate from the loading resistant coating. Even when the coating weight of lithium stearate was higher than that of calcium stearate, transfer of lithium stearate was considerably less than that of calcium stearate. In general, if the weight of the loading resistant coating is high, more coating material will transfer; consequently, the results of the foregoing examples were unexpected. Moreover, the addition of lithium stearate to zinc stearate results in less transfer of loading resistant coating material than does a coating made of zinc stearate only.

OFFHAND SANDING TEST

The 12.7 centimeter diameter coated abrasive disc was secured to a 12.7 centimeter diameter support pad by means of a tape having a backing bearing a layer of pressure-sensitive adhesive on both major surfaces thereof. The support pad was connected to a random orbital sander operating at 10,000 rpm. The coated abrasive disc was used to sand a painted panel for three minutes. The amount of paint removed, which corresponded to the abrading properties of the coated abrasive, was calculated. The results are set forth in Table 2.

TABLE 2

| Example | Amount of paint removed (g) |
|---|---|
| Control A | 0.83 |
| Control B | 0.92 |
| 1 | 1.00 |
| 2 | 0.99 |

It can be seen from the data in Table 2 that lithium stearate is effective as a loading resistant coating for an abrasive product.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A package of coated abrasive articles comprising at least two coated abrasive articles wherein each coated abrasive product comprises:

a. a backing, b. a layer of abrasive grains secured to one major surface of said backing by at least one binder, c. a loading resistant coating applied over said layer of abrasive grains, wherein said loading resistant coating comprises a lithium salt of a fatty acid, and d. a layer of pressure-sensitive adhesive applied to the major surface of the backing opposite the major surface bearing the abrasive grains, wherein the loading resistant coating of one of the coated abrasive articles is in direct, releasable contact with the pressure-sensitive adhesive layer of another of the coated abrasive articles.

2. The coated abrasive according to claim 1, wherein the loading resistant coating further comprises at least one member selected from the group consisting of binders, surfactants, wetting agents, anti-foaming agents, fillers, dyes, pigments, anti-static agents, and plasticizers.

3. The coated abrasive according to claim 1, wherein the lithium salt of a fatty acid is selected from the group consisting of lithium stearate, lithium palmitate, lithium myristate, lithium laurate, lithium decanoate, lithium octanoate, lithium undecylenate, and lithium oleate.

4. The coated abrasive according to claim 1, wherein the lithium salt of a fatty acid is lithium stearate.

5. The coated abrasive according to claim 1, wherein the pressure-sensitive adhesive is an isooctylacrylate:acrylic acid copolymer.

6. A coated abrasive article comprising a convolutely wound concatenation of coated abrasive discs, wherein each coated abrasive disc comprises:

a. a backing, b. a layer of abrasive grains secured to one major surface of said backing by at least one binder, c. a loading resistant coating applied over said layer of abrasive grains, wherein said loading resistant coating comprises a lithium salt of a fatty acid, and d. a layer of pressure-sensitive adhesive applied to the major surface of the backing opposite the major surface bearing the abrasive grains, wherein each of said discs is joined to at least one other disc along a line substantially tangent to the discs, said tangent line being of a length less than one-half the radius of the discs, wherein the pressure-sensitive adhesive layer of one of said discs is in direct, releasable contact with the loading resistant coating of another of said discs.

7. A coated abrasive article in the form of a roll comprising a backing bearing on one major surface thereof a layer of abrasive grains, said abrasive grains adhered to said backing by at least one binder, overlying said layer of abrasive grains a loading resistant coating comprising a lithium salt of fatty acid, said backing bearing on the other major surface thereof a layer of pressure-sensitive adhesive, wherein the loading resistant coating of the coated abrasive article is in direct, releasable contact with the layer of pressure-sensitive adhesive of the coated abrasive article.

8. The coated abrasive according to claim 6, wherein the loading resistant coating further comprises at least one member selected from the group consisting of binders, surfactants, wetting agents, anti-foaming agents, fillers, dyes, pigments, anti-static agents, and plasticizers.

9. The coated abrasive according to claim 6, wherein the lithium salt of a fatty acid is selected from the group consisting of lithium stearate, lithium palmitate, lithium myristate, lithium laurate, lithium decanoate, lithium octanoate, lithium undecylenate, and lithium oleate.

10. The coated abrasive according to claim 6, wherein the lithium salt of a fatty acid is lithium stearate.

11. The coated abrasive according to claim 6, wherein the pressure-sensitive adhesive is an isooctylacrylate:acrylic acid copolymer.

12. The coated abrasive according to claim 7, wherein the loading resistant coating further comprises at least one member selected from the group consisting of binders, surfactants, wetting agents, anti-foaming agents, fillers, dyes, pigments, anti-static agents, and plasticizers.

13. The coated abrasive according to claim 7, wherein the lithium salt of a fatty acid is selected from the group consisting of lithium stearate, lithium palmitate, lithium myristate, lithium laurate, lithium decanoate, lithium octanoate, lithium undecylenate, and lithium oleate.

14. The coated abrasive according to claim 7, wherein the lithium salt of a fatty acid is lithium stearate.

15. The coated abrasive according to claim 7, wherein the pressure-sensitive adhesive is an isooctylacrylate:acrylic acid copolymer.

* * * * *